US011828087B2

(12) United States Patent
Chen

(10) Patent No.: US 11,828,087 B2
(45) Date of Patent: Nov. 28, 2023

(54) CONTROL STRUCTURE OF DOOR LOCK

(71) Applicant: Jeff Chen, Chiayi (TW)

(72) Inventor: Jeff Chen, Chiayi (TW)

( * ) Notice: Subject to any disclaimer, the term of this patent is extended or adjusted under 35 U.S.C. 154(b) by 204 days.

(21) Appl. No.: 17/515,716

(22) Filed: Nov. 1, 2021

(65) Prior Publication Data

US 2023/0139198 A1 May 4, 2023

(51) Int. Cl.

| | |
|---|---|
| ***E05B 47/00*** | (2006.01) |
| ***E05B 55/00*** | (2006.01) |
| ***E05B 63/08*** | (2006.01) |
| ***E05B 63/00*** | (2006.01) |
| ***E05B 47/02*** | (2006.01) |

(52) U.S. Cl.
CPC ..... *E05B 47/0012* (2013.01); *E05B 47/026* (2013.01); *E05B 55/005* (2013.01); *E05B 63/0056* (2013.01); *E05B 63/08* (2013.01); *E05B 2047/002* (2013.01)

(58) Field of Classification Search
CPC .... E05B 47/00; E05B 47/0001; E05B 47/026; E05B 47/0012; E05B 55/00; E05B 55/005; E05B 63/00; E05B 63/08; E05B 63/10; E05B 63/006; E05B 63/0056; E05B 2047/002; E05B 2047/0013
USPC ..... 292/137; 70/277
See application file for complete search history.

(56) References Cited

U.S. PATENT DOCUMENTS

| | | | | |
|---|---|---|---|---|
| 5,647,617 | A * | 7/1997 | Kajuch | E05B 55/12 292/336.5 |
| 6,419,288 | B1 * | 7/2002 | Wheatland | E05C 1/163 292/DIG. 60 |
| 2004/0130162 | A1 * | 7/2004 | Don | E05B 63/06 292/1.5 |
| 2010/0263418 | A1 * | 10/2010 | Moon | E05B 63/16 292/61 |
| 2012/0013135 | A1 * | 1/2012 | Moon | E05B 17/2026 292/165 |
| 2017/0275926 | A1 * | 9/2017 | Kumar | E05B 55/12 |

* cited by examiner

*Primary Examiner* — David R Hare
*Assistant Examiner* — James Edward Ignaczewski

(57) ABSTRACT

A control structure of a door lock contains: a body, a partition, a motor, a slide cylinder, a rotatable sheet, a tongue, a locating bolt, a first resilient element, and a second resilient element. The body includes a first casing, a second casing, an open segment, a close segment, an operation space, a holder, and a groove. The partition includes a first slot, multiple actuation portions, two hooks, two seats, two connection orifices, and multiple extensions. The motor includes a guide gear, and the slide cylinder includes an accommodation chamber, a receiving trench, at least one second slot, and a post. The rotatable sheet includes a curved face, a chute, a drive section, and a toothed portion. The tongue includes a lock segment, a notch, an engagement segment, two fixing portions, and two retainers. The locating bolt includes a defining fringe and a connection protrusion.

3 Claims, 6 Drawing Sheets

CONTROL STRUCTURE OF DOOR LOCK

BACKGROUND OF THE INVENTION

Field of the Invention

The present invention relates to a control structure of a door lock by which the motor and the guide gear actuate the rotatable sheet, the slide cylinder, and the tongue extend out of or retract into the open segment of the body so as to unlock or lock the door lock easily.

Description of the Prior Art

A conventional door lock is connected by several components, so it is operated badly after a period of using time. Furthermore, the conventional deadbolt is deformed easily after being hit.

The present invention has arisen to mitigate and/or obviate the afore-described disadvantages.

SUMMARY OF THE INVENTION

The primary object of the present invention is to provide a control structure of a door lock by which the motor and the guide gear actuate the rotatable sheet, the slide cylinder, and the tongue extend out of or retract into the open segment of the body so as to unlock or lock the door lock easily.

Further object of the present invention is to provide a control structure of a door lock which contains the first casing and the second casing one-piece formed to reinforce the control structure of the lock door greatly.

Another object of the present invention is to provide a control structure of a door lock which contains the tongue pushed by the locating bolt safely.

DETAILED DESCRIPTION OF THE PREFERRED EMBODIMENTS

Figure 1:
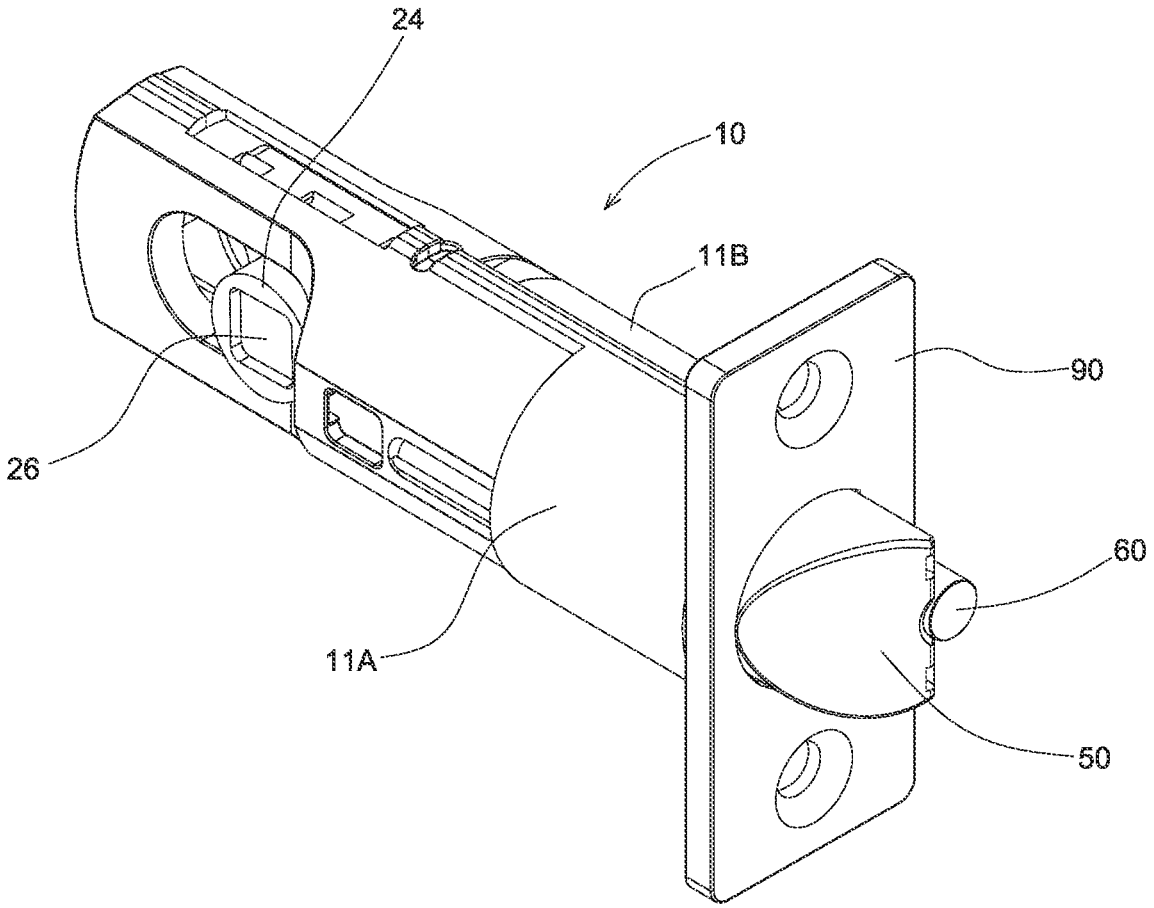
FIG. 1 is a perspective view showing the assembly of a control structure of a door lock according to a preferred embodiment of the present invention.
Figure 2:
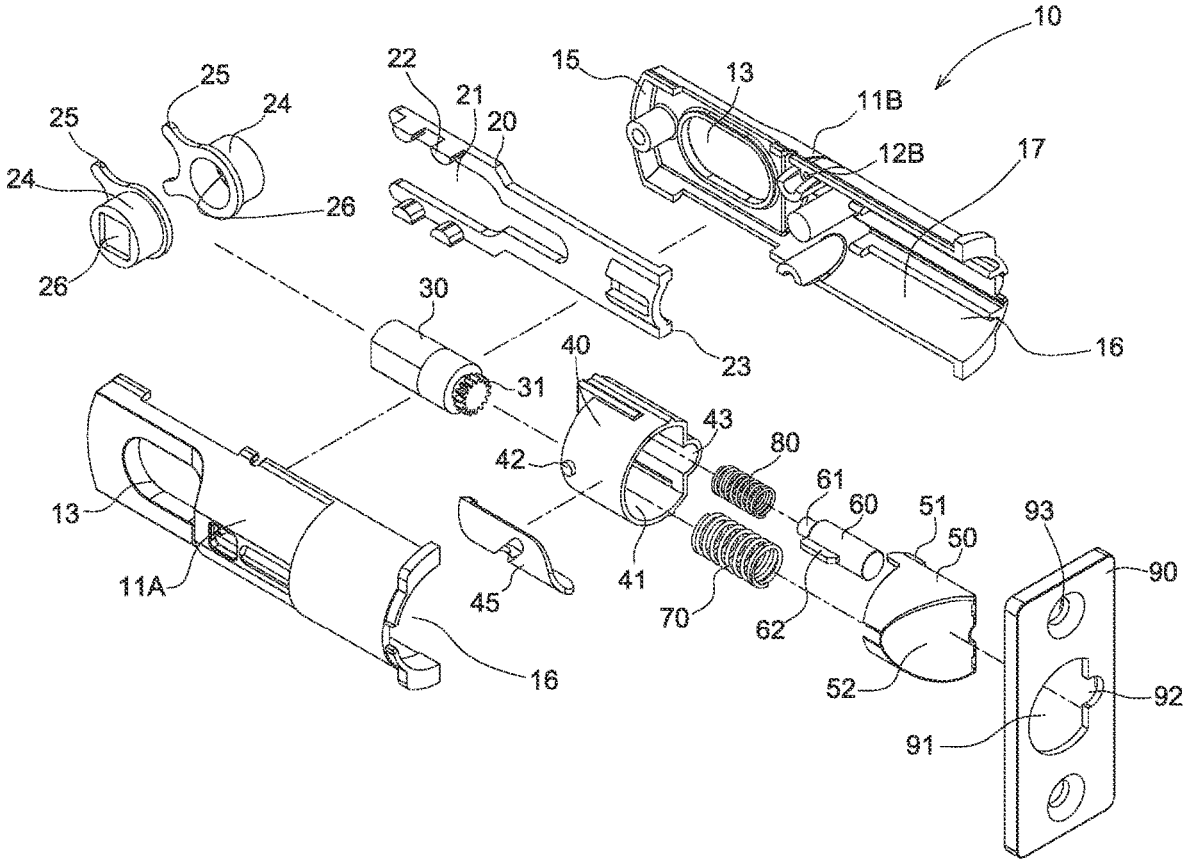
FIG. 2 is a perspective view showing the exploded components of the control structure of the door lock according to the preferred embodiment of the present invention.
Figure 3:
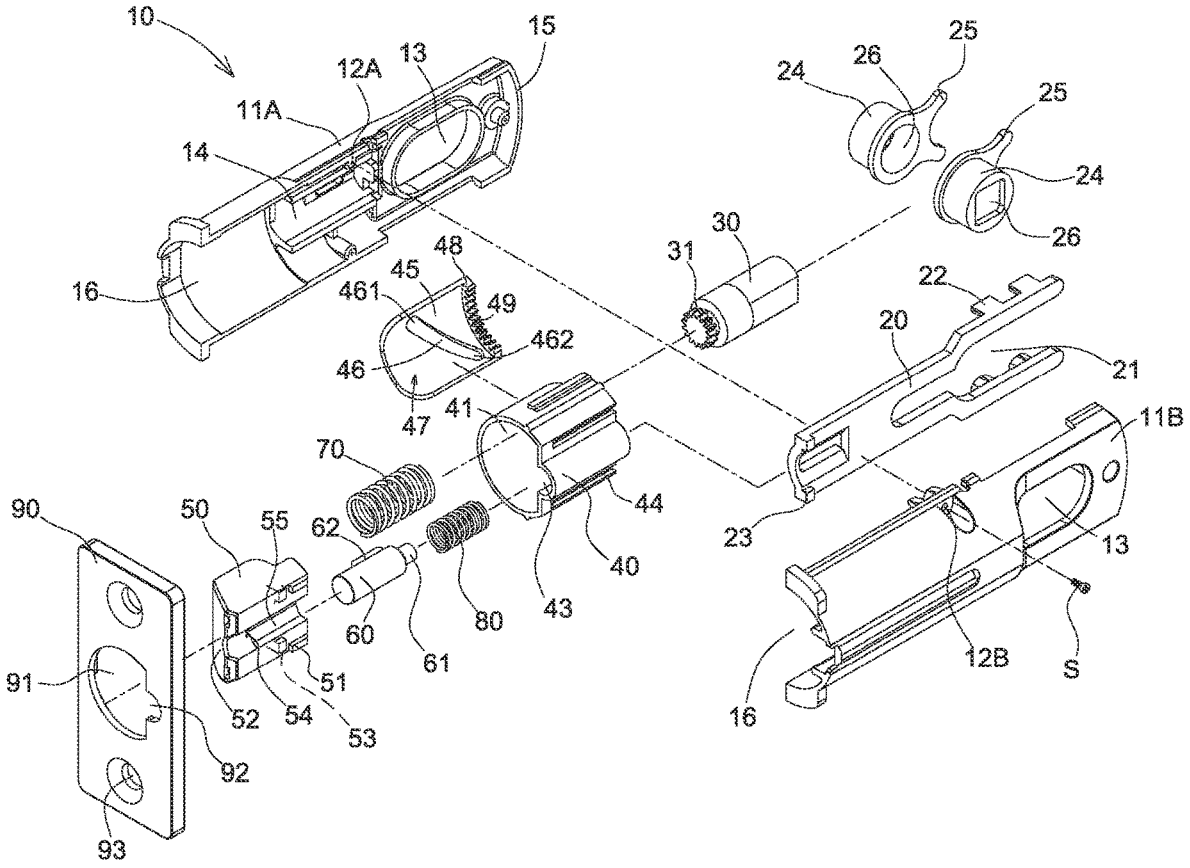
FIG. 3 is another perspective view showing the exploded components of the control structure of the door lock according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-7, a control structure of a door lock according to a preferred embodiment of the present invention comprises:

- a body 10 including a first casing 11A and a second casing 11B which are one-piece formed, an open segment 16 formed on a first end of the body 10, a close segment 15 formed on a second end of the body 10, an operation space 17 defined in the body 10, a holder 14 formed in the body 10 opposite to the operation space 17, and a groove 13 defined in the body 10 facing the close segment 15; wherein the first casing 11A has a first connection portion 12A, and the second casing 11B has a second connection portion 12B corresponding to the first connection portion 12A of the first casing 11A, wherein the first connection portion 12A and the second connection portion 12B are connected by a screw bolt S so as to form the body 10;
- a partition 20 received in the body 10 and including a first slot 21 defined on a first end of the partition 20 and corresponding to the groove 13 of the body 10, multiple actuation portions 22 extending around the first slot 21, two hooks 23 extending from a side of a second end of the partition 20 and corresponding to the open segment 16 of the body 10, two seats 24 received in the first slot 21 and the groove 13 of the body 10, two connection orifices 26 defined on the two seats 24, multiple extensions 25 extending from the two seats 24 and corresponding to the multiple actuation portions 22 of the partition 20;
- a motor 30 accommodated in the holder 14 of the body 10 and including a guide gear 31 corresponding to a center of the open segment 16 of the body 10;
- a slide cylinder 40 received in the body 10 and including an accommodation chamber 41 corresponding to the open segment 16 of the body 10, a receiving trench 43 defined beside the accommodation chamber 41 and configured to receive the partition 20, at least one second slot 44 extending on an outer wall of the slide cylinder 40, and a post 42 extending from a predetermined position of the outer wall of the slide cylinder 40 opposite to the at least one second slot 44;
- a rotatable sheet 45 accommodated in the slide cylinder 40 and corresponding to the guide gear 31 of the motor 30, the rotatable sheet 45 including a curved face 47 defined on an inner wall of the rotatable sheet 45, a chute 46 defined on the curved face 47 and configured to receive the post 42 of the slide cylinder 40, wherein the chute 46 has a first positioning segment 461 defined on a first end thereof, and the chute 46 has a second positioning segment 462 formed on a second end thereof, the rotatable sheet 45 further including a drive section 48 formed around the inner wall thereof, and a toothed portion 49 formed on the drive section 48 and meshing with the guide gear 31 of the motor 30 so that when the guide gear 31 is driven by the motor 30, the guide gear 31 actuates the toothed portion 49 to move, and the rotatable sheet 45 actuates the post 42 of the slide cylinder 40 to move forward or backward via the chute 46;
- a tongue 50 received in the accommodation chamber 41 of the slide cylinder 40, and the tongue 50 including a lock segment 52 formed on a first end of the tongue 50, a notch 55 defined on a side wall of the tongue 50, an engagement segment 54 formed in the notch 55 opposite to the accommodation chamber 41, two fixing portions 53 located above and below the accommodation chamber 41 and corresponding to the two hooks 23 of the partition 20, and two retainers 51 extending beside the notch 55 and adjacent to a second end of the tongue 50 so as to engage with the at least one slot 44 of the slide cylinder 40;

a locating bolt 60 accommodated in the notch 55 of the tongue 50, the locating bolt 60 including a defining fringe 62 formed on a side of the locating bolt 60 and engaged with the engagement segment 54 of the tongue 50, and a connection protrusion 61 extending from an end of the locating bolt 60;

a first resilient element 70, wherein a first end of the first resilient element 70 is fixed in the accommodation chamber 41 of the slide cylinder 40, and a second end of the first resilient element 70 is mounted on the tongue 50; and a second resilient element 80, wherein a first end of the second resilient element 80 is disposed in the accommodation chamber 41 of the slide cylinder 40, and a second end of the second resilient element 80 is secured on the connection protrusion 61 of the locating bolt 60.

Preferably, the body 10 further includes a coupling plate 90 facing the open segment 16, and the coupling plate 90 has a first aperture 91 defined on a center thereof, a second aperture 92 formed on a side of the coupling plate 90, and two third apertures 93 formed proximate to a top and a bottom of the coupling plate 90.

Figure 4:
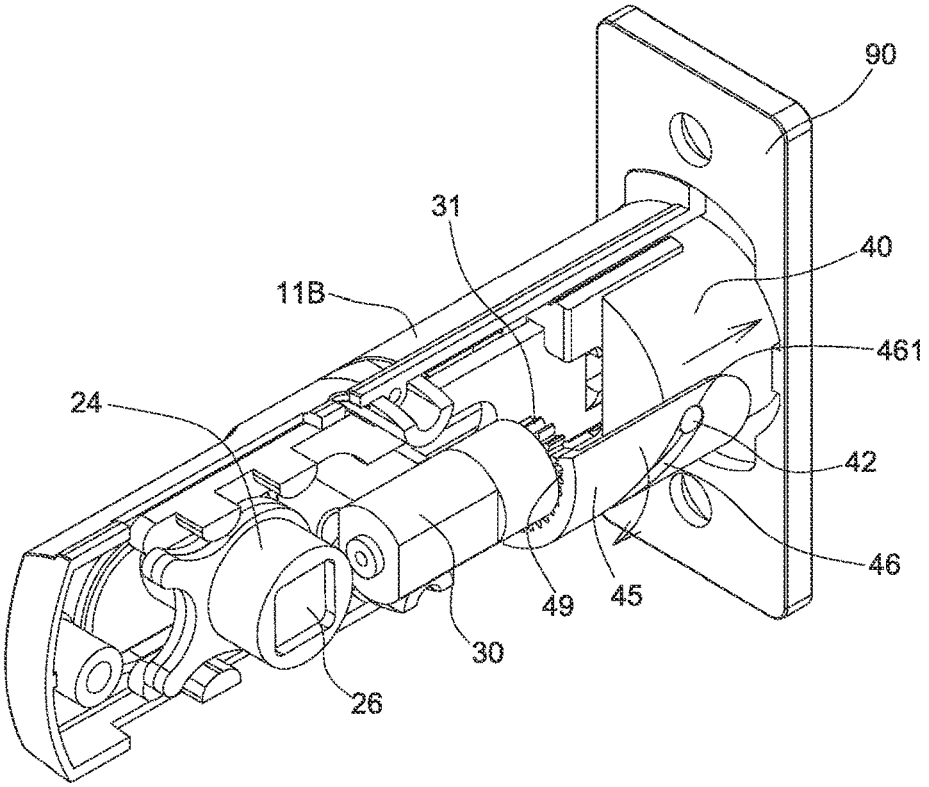
FIG. 4 is a perspective view showing the operation of the control structure of the door lock according to the preferred embodiment of the present invention.
Figure 6:
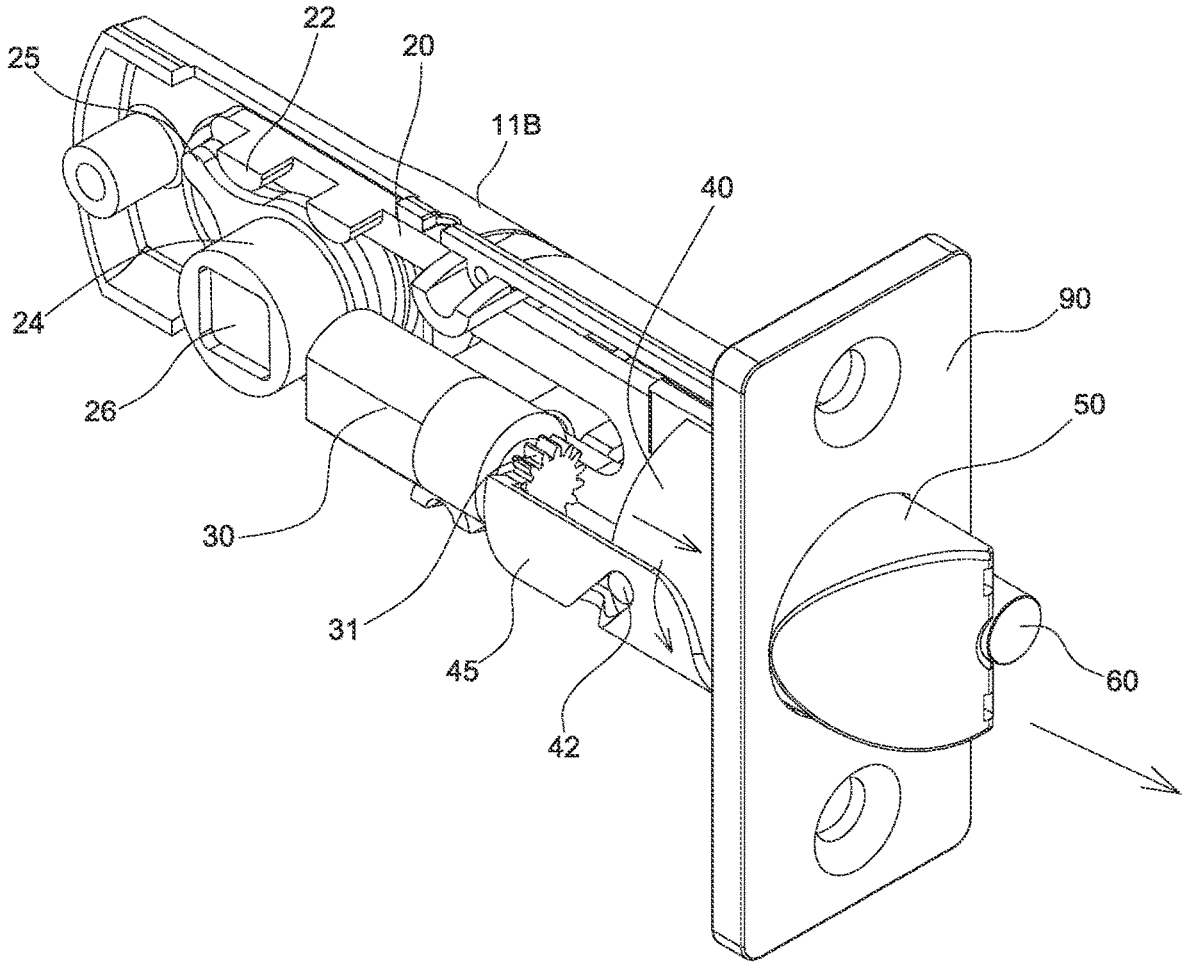
FIG. 6 is also another perspective view showing the operation of the control structure of the door lock according to the preferred embodiment of the present invention.

Referring to FIGS. 4 and 6, when the tongue 50 extends in an electric driving mode, the motor 30 rotatably drives the guide gear 31 so that the guide gear 31 meshes with the toothed portion 49 to move rotatably, and after the rotatable sheet 45 actuates the post 42 of the slide cylinder 40 to move forward or backward via the chute 46, the post 42 moves into the first positioning segment 461 of the chute 46, and the slide cylinder 40 actuates the tongue 50 to extend out of the open segment 16 of the body 10. When the slide cylinder 40 moves forward, the slide cylinder 40 pushes the tongue 50 to extend out of the open segment 16 of the body 10 by way of the first resilient element 70.

Figure 5:
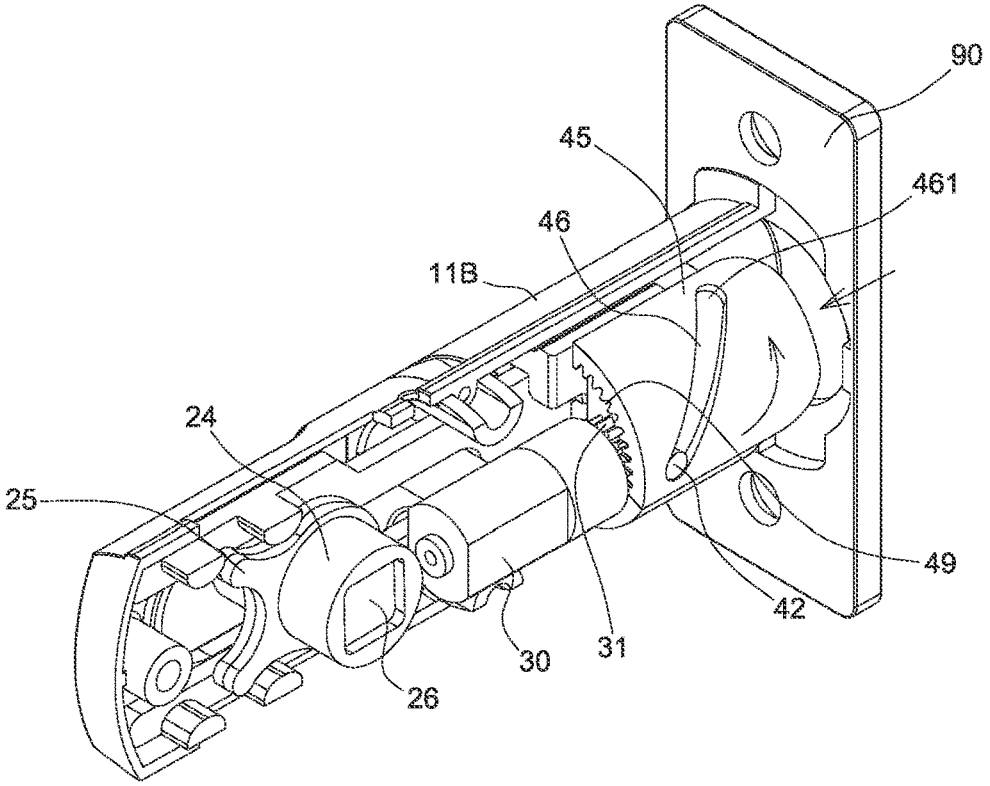
FIG. 5 is another perspective view showing the operation of the control structure of the door lock according to the preferred embodiment of the present invention.
Figure 7:
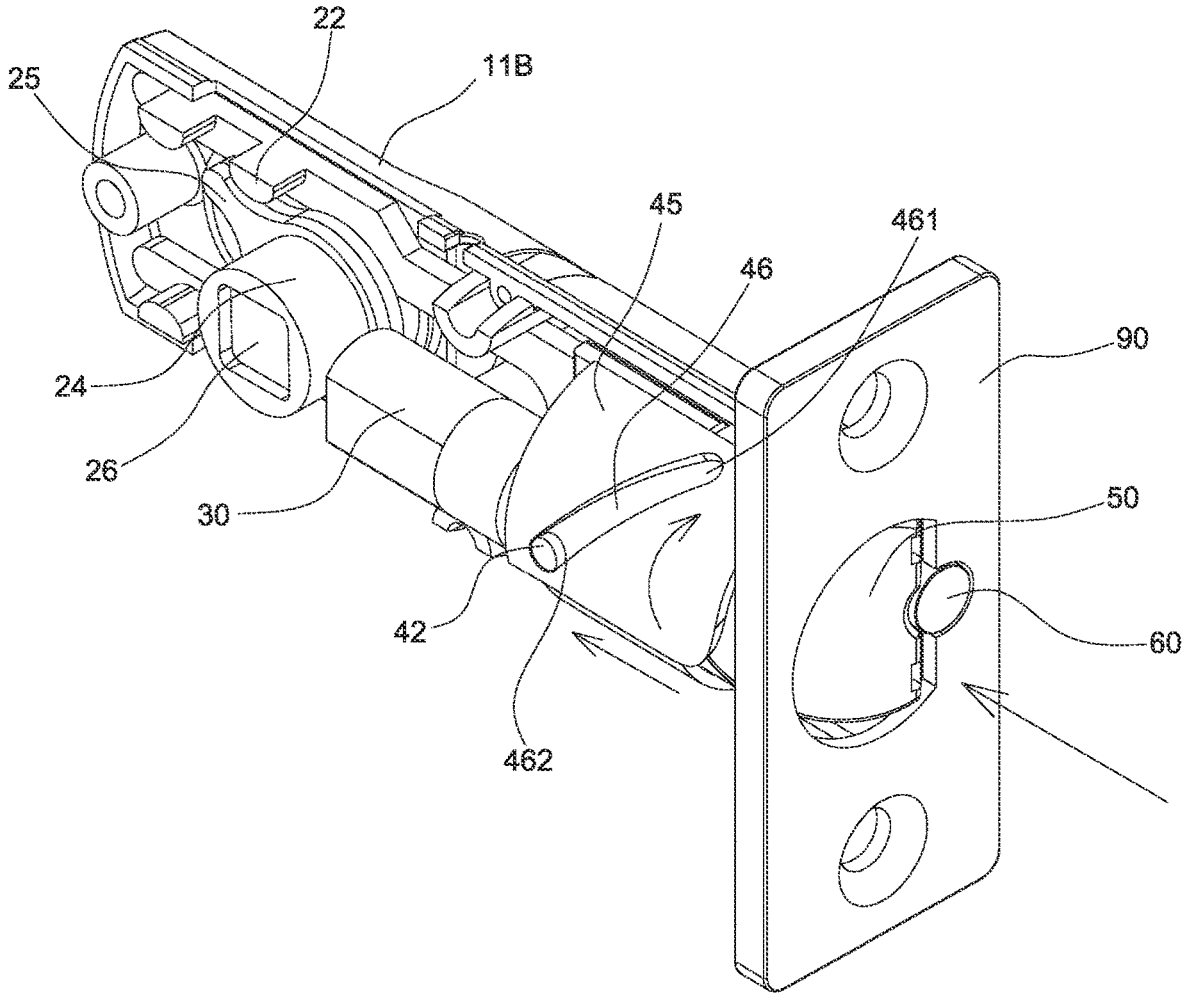
FIG. 7 is still another perspective view showing the operation of the control structure of the door lock according to the preferred embodiment of the present invention.

As shown in FIGS. 5 and 7, the tongue 50 is driven to retract inward in the electric driving mode, wherein the motor 30 rotates counterclockwise to drive the guide gear 31 to rotate so that the guide gear 31 actuates the toothed portion 49 to rotate counterclockwise via the motor 30, and the rotatable sheet 45 moves counterclockwise to drive the post 42 and the slide cylinder 40 to move backward via the chute 46, then the post 42 moves into the second positioning segment 462 of the chute 46, and the slide cylinder 40 drives the tongue 50 to retract into the open segment 16 of the body 10.

Accordingly, the motor 30 and the guide gear 31 actuate the rotatable sheet 45, the slide cylinder 40, and the tongue 50 to extend out of or retract into the open segment 16 of the body 10 so as to unlock or lock the door lock easily. Preferably, the first casing 11A and the second casing 11B of the body 10 are one-piece formed to reinforce the control structure of the lock door, and the tongue 50 is pushed by the locating bolt 60 safely.

While various embodiments in accordance with the present invention have been shown and described, it is clear to those skilled in the art that further embodiments may be made without departing from the scope of the present invention.

What is claimed is:

1. A control structure of a door lock comprising:

a body including a first casing and a second casing which are one-piece formed, an open segment formed on a first end of the body, a close segment formed on a second end of the body, an operation space defined in the body, a holder formed in the body opposite to the operation space, and a groove defined in the body facing the close segment;

a partition received in the body and including a first slot defined on a first end of the partition and corresponding to the groove of the body, multiple actuation portions extending around the first slot, two hooks extending from a side of a second end of the partition and corresponding to the open segment of the body, two seats received in the first slot and the groove of the body, two connection orifices defined on the two seats, multiple extensions extending from the two seats and corresponding to the multiple actuation portions of the partition;

a motor accommodated in the holder of the body and including a guide gear corresponding to a center of the open segment of the body;

a slide cylinder received in the body and including an accommodation chamber corresponding to the open segment of the body, a receiving trench defined beside the accommodation chamber and configured to receive the partition, at least one second slot extending on an outer wall of the slide cylinder, and a post extending from a predetermined position of the outer wall of the slide cylinder opposite to the at least one second slot;

a rotatable sheet accommodated in the slide cylinder and corresponding to the guide gear of the motor, the rotatable sheet including a curved face defined on an inner wall of the rotatable sheet, a chute defined on the curved face and configured to receive the post of the slide cylinder, wherein the chute has a first positioning segment defined on a first end thereof, and the chute has a second positioning segment formed on a second end thereof, the rotatable sheet further including a drive section formed around the inner wall thereof, and a toothed portion formed on the drive section and meshing with the guide gear of the motor so that when the guide gear is driven by the motor, the guide gear actuates the toothed portion to move, and the rotatable sheet actuates the post of the slide cylinder to move forward or backward via the chute;

a tongue received in the accommodation chamber of the slide cylinder, and the tongue including a lock segment formed on a first end of the tongue, a notch defined on a side wall of the tongue, an engagement segment formed in the notch opposite to the accommodation chamber, two fixing portions located above and below the accommodation chamber and corresponding to the two hooks of the partition, and two retainers extending beside the notch and adjacent to a second end of the tongue so as to engage with the at least one slot of the slide cylinder;

a locating bolt accommodated in the notch of the tongue, the locating bolt including a defining fringe formed on a side of the locating bolt and engaged with the engagement segment of the tongue, and a connection protrusion extending from an end of the locating bolt;

a first resilient element, wherein a first end of the first resilient element is fixed in the accommodation chamber of the slide cylinder, and a second end of the first resilient element is mounted on the tongue; and a second resilient element, wherein a first end of the second resilient element is disposed in the accommodation chamber of the slide cylinder, and a second end of the second resilient element is secured on the connection protrusion of the locating bolt.

2. The control structure as claimed in claim 1, wherein the first casing has a first connection portion, and the second casing has a second connection portion corresponding to the first connection portion of the first casing, wherein the first connection portion and the second connection portion are connected by a screw bolt so as to form the body.

3. The control structure as claimed in claim 1, wherein the body further includes a coupling plate facing the open segment, and the coupling plate has a first aperture defined on a center thereof, a second aperture formed on a side of the coupling plate, and two third apertures formed proximate to a top and a bottom of the coupling plate.

* * * * *